US006495212B1

(12) United States Patent
Gupta

(10) Patent No.: US 6,495,212 B1
(45) Date of Patent: Dec. 17, 2002

(54) FUNCTIONALLY GRADIENT MATERIALS AND THE MANUFACTURE THEREOF

(75) Inventor: Manoj Gupta, Singapore (SG)

(73) Assignee: National University of Singapore, Singapore (SG)

( * ) Notice: Subject to any disclaimer, the term of this patent is extended or adjusted under 35 U.S.C. 154(b) by 0 days.

(21) Appl. No.: 09/720,612

(22) PCT Filed: Jun. 4, 1999

(86) PCT No.: PCT/SG99/00055

§ 371 (c)(1),
(2), (4) Date: May 9, 2001

(87) PCT Pub. No.: WO99/67075

PCT Pub. Date: Dec. 29, 1999

(30) Foreign Application Priority Data

Jun. 23, 1998 (SG) ..... 9801486

(51) Int. Cl.[7] ..... B05D 1/02
(52) U.S. Cl. ..... 427/422; 427/421; 427/427
(58) Field of Search ..... 427/256, 280, 427/420, 421, 422, 446, 448, 450, 451, 452, 453, 454, 455, 456, 287, 427; 75/684, 678

(56) References Cited

U.S. PATENT DOCUMENTS 5,622,542 A * 4/1997 Thomas et al. ..... 75/415
5,718,863 A * 2/1998 McHugh et al. ..... 264/309
5,980,604 A * 11/1999 Lavernia ..... 75/338
6,037,066 A * 3/2000 Kuwabara ..... 428/610
6,106,588 A * 8/2000 Skibo et al. ..... 75/684

* cited by examiner

*Primary Examiner*—Shrive P. Beck
*Assistant Examiner*—Eric B Fuller
(74) *Attorney, Agent, or Firm*—David Jaffer; Pillsbury Winthrop LLP

(57) ABSTRACT

This invention relates to the synthesis of Al/SiC based functionally gradient materials using a new technique termed here as gradient slurry disintegration and deposition. Gradients of SiC were successfully established using this technique for the starting weight percentages up to 20%. The results were confirmed using microstructural characterization techniques and microhardness measurements. Functionally gradient materials synthesized using this method holds the promise where differential tribological characteristics and the strength/toughness combinations may be required from the opposite surfaces.

13 Claims, 2 Drawing Sheets

FUNCTIONALLY GRADIENT MATERIALS AND THE MANUFACTURE THEREOF

The present invention relates to functionally gradient materials such as aluminium/silicon carbide (Al/SiC) based functionally gradient materials. The present invention also relates to processes for the manufacture of functionally gradient materials.

Functionally gradient materials exhibit a variation in chemical composition and/or microstructural parameters, which variation occurs between regions of the material. Typically, such variations will occur across the cross-section of the material thereby providing distinct chemical and micro-structural properties at the two opposed surfaces. Functionally gradient materials may be used to provide a component with opposed surfaces having different tribological characteristics and strength/toughness combinations.

Functionally gradient materials are typically synthesized using a number of techniques that can broadly be classified as: (a) vapour phase techniques, (b) liquid phase techniques, and (c) solid phase techniques. These techniques, besides having their suitability limited to certain specific applications, suffer from one or more of the following limitations: (i) low thickness of the functionally gradient bulk material or coating, (ii) low deposition rate, (iii) complex process requirements, and (iv) high cost of operating the process.

We have now found that functionally gradient materials may be produced using a process which involves the vortex mixing of the ceramic phase in molten metal followed by in-mold gas disintegration and deposition of the gradient composite.

Accordingly there is provided a process for the manufacture of a metal/ceramic based functionally gradient material comprising the steps of:

(i) melting a metal in a crucible;

(ii) adding a solid particulate ceramic material to the molten metal;

(iii) vortex mixing the molten metal and particulate ceramic material to form a gradient slurry;

(iv) allowing the slurry to flow from the crucible; and (v) disinegrating the slurry using jets of inert gas such that the disintegrated slurry is deposited on a substrate to form the functionally gradient material.

The invention also provides a functionally gradient material manufactured by the process described in the immediately preceding paragraph.

As used herein the term "vortex mixing" refers to a mixing or stirring using an impeller, wherein the impeller is lowered into a liquid or slurry to be mixed and driven by a device such as a motor for a predetermined period of time.

As used herein the term "gradient slurry" refers to a slurry of molten metal and particulate ceramic material, wherein the concentration of the ceramic material varies gradiently through the depth of the slurry.

Metal/ceramic based functionally gradient material produced by the process of the present invention advantageously exhibits a structure showing gradual variation in the concentration of the ceramic particles from the base to the top of the deposited material. Such a structure generally has a low concentration of ceramic particles at the base of the deposited material, gradually increasing to a high concentration at the top.

The functionally gradient materials thus produced advantageously show a relatively uniform distribution of ceramic particles both in the regions of high and low concentrations.

The uniform distribution of ceramic particles can be attributed to the dynamic events resulting from the disintegration and deposition step of the processing. We have observed a high degree of uniformity in the distribution of ceramic particles in low concentration regions and a decrease in uniformity of distribution associated with an increase in ceramic particle concentration. This indicates that the top of the deposited material, in general, exhibits an increased tendency of clustering of ceramic particles when compared to the base of the deposited material.

Metals suitable for use as the matrix of the metal/ceramic functionally gradient material include elemental metals and alloys. Examples of suitable metals include aluminium, titanium, magnesium and copper in their elemental as well as alloy forms.

In the process of the present invention the metal is melted in an inert crucible or other suitable container. The metal may be melted by resistance melting based techniques.

The molten metal is then held at a temperature at which it is particularly suited for the blending of solid particulate ceramic materials. The holding temperature may vary from metal to metal and should be equal to or higher than the temperature required by the metal/alloy to wet the ceramic particles. This facilitates the ready incorporation of ceramic particles in the melt.

The solid particulate ceramic materials suitable for use in the present invention include, for example, silicon carbide (SiC), graphite and alumina particles. These particles may, for example, be used in the size range of 3 $\mu$m–100 $\mu$m. The metal/alloy and the ceramic particles advantageously have a significant difference in their density values. Typical examples include the selection of graphite (2.2 g/cc) or SiC (3.2 g/cc) for aluminium based (~2.7 g/cc) matrices.

The vortex mixing of the solid particulate ceramic material into the molten metal preferably includes the stirring of a superheated melt at a speed which is capable of creating a vortex in the melt followed by the gradual addition of ceramic particles into the melt. The judicious selection of melt superheating temperature, stirring speed and mode of ceramic particle addition ensures the incorporation and desired distribution of ceramic particles in the liquid melt. Preferably vortex mixing is carried out in the crucible, for example, a 2.5 kg crucible (using brass as a reference) having a height of about 109 mm, an upper outer diameter of 95 mm and a lower outer diameter of 61 mm, using a stirring rod, for example, having a shaft length of 24 cm and a circular head of about 35 mm diameter. The stirring rod is preferably lowered the lowest possible position in the crucible which does not result in the rod touching the walls of the crucible during stirring. Stirring is preferably conducted at speed of about 250 to about 310 rpm.

The mixed blend is then allowed to flow from the crucible, for example through a central hole in the base of the crucible, and is subsequently disintegrated. Care should be taken to minimize the time between the end of ceramic particles addition and the start of disintegration.

The disintegration is carried out using jets of inert gas. The jets of inert gas are preferably aligned at about 90° to the axis of the slurry stream flowing from the crucible. Suitable inert gases for use in disintegrating the poured molten mixture include for example argon and nitrogen.

The resultant disintegrated mixture thus obtained is deposited onto a substrate, such as a metallic substrate. Typical metals used for substrate include for example iron and copper based materials. The process allows the substrate to be used at ambient temperature thus minimising the operating cost of the process.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The present invention is further described by reference to the following non-limiting examples.

EXAMPLES

Three Al/SiC based functionally gradient/gradient materials were fabricated. The three materials are designated as Al/15SiC, Al/18SiC and Al/20SiC. These designations indicate that they were fabricated with the starting SiC weight percentages of 15, 18 and 20 respectively. Pure aluminium (99.5%) and silicon carbide (SiC) of particle size ~35 $\mu$m were used as the metallic and ceramic phases respectively. Rectangular pieces of aluminum were cut and subsequently washed using water and acetone to remove the surface impurities. After weighing, the cleaned pieces were placed in graphite crucible and superheated to a temperature of 950° C. The SiC particulates were preheated to 950° C. and were added into the molten aluminum melt stirred using a zirconia coated stirrer at 294 rpm. The selection of stirring speed was made so as to allow controlled sedimentation of SiC particulates. The total addition time of SiC particulates was limited to 20 minutes. The molten mixture thus obtain in the crucible was allowed to flow through a centrally drilled hole in the crucible into a 11.2 mm diameter stream and was disintegrated using argon gas jets at a distance of ~248 mm from the pouring point using a gas flow rate limited to 50 litres per minute and subsequently deposited into a metallic substrate at ambient temperatures located at a distance of 428 mm from the pouring point. A deposition thickness of 40 mm was consistently and easily achieved in about 1 minute.

These materials were characterized in terms of spatial distribution of SiC particulates, porosity and microhardness of the metallic matrix. Weight percentages of SiC particulates were determined using acid dissolution method as described in M. Gupta, M. O. Lai and C. Y. Soo, *Mat. Sci. Eng. A,* 210/1–2, 1996, 114; porosity was determined using the results of density measurements obtained using Archimedes principal as described in M. Gupta, S. C. Lim and W. B. Ng, Mat. Sci. and Tech., 13(7), 1997, 584, and the results of acid dissolution. Microhardness measurements were made using an automated Matsuzawa Digital Microhardness Tester with a pyramidal diamond indenter using an indentation load of 200 g and a loading speed of 50 $\mu$m/s. The results of such measurements for all the three types of functionally gradient/gradient materials are shown in FIGS. 1–6, in which:

In addition to the graphical representation of the variation in weight percentage SiC, porosity and the microhardness, Table 1 shows the minimum and maximum weight percentages of SiC incorporated on the two opposite sides of the functionally gradient/gradient materials synthesized in the present study.

TABLE 1

Minimum and maximum Weight Percentage of SiC and its Gradient achieved in the three functionally gradient/gradient materials synthesized in the present study.

| Material | Minimum Wt % SiC (High Al end) | Maximum Wt % SiC (High SiC end) | Average Gradient (Wt % SiC/mm) |
|---|---|---|---|
| Al/15SiC | 1.5 | 12.3 | 0.31 |
| Al/18SiC | 1.9 | 15.9 | 0.40 |
| Al/20SiC | 2.4 | 16.6 | 0.41 |

Figure 1:
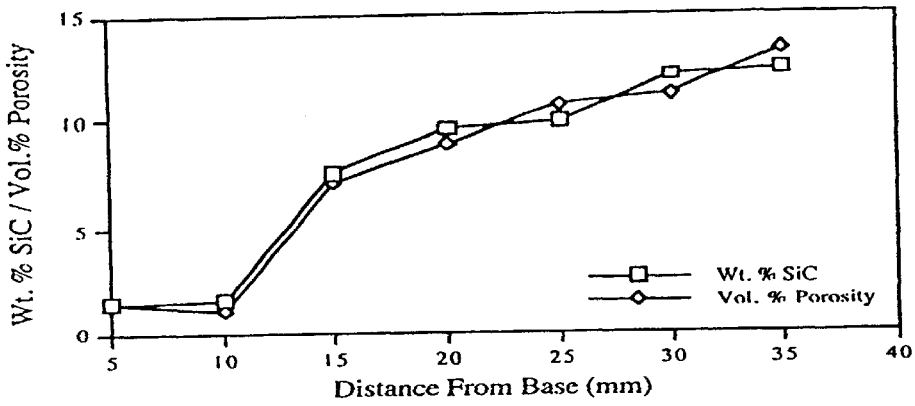
FIG. 1 is a graphical representation of gradient of SiC particulates and volume percent porosity in the case of Al/15SiC functionally gradient material.
Figure 2:
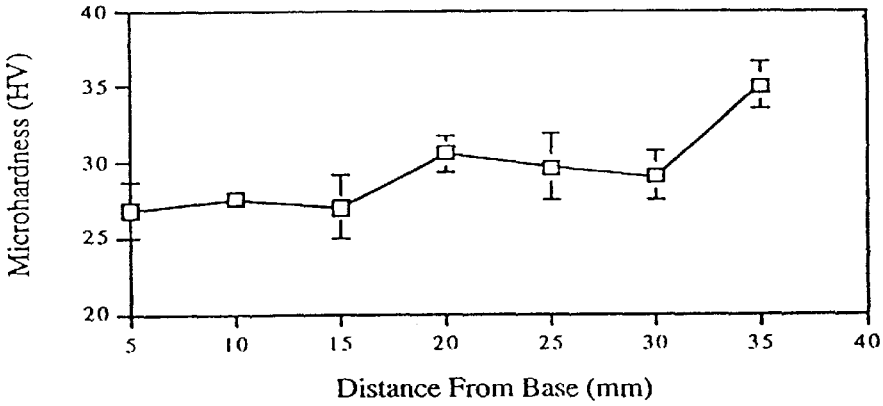
FIG. 2 is a graphical representation of variation in microhardness as a result of presence of gradient of SiC particulates in the case of Al/15SiC functionally gradient material.
Figure 3:
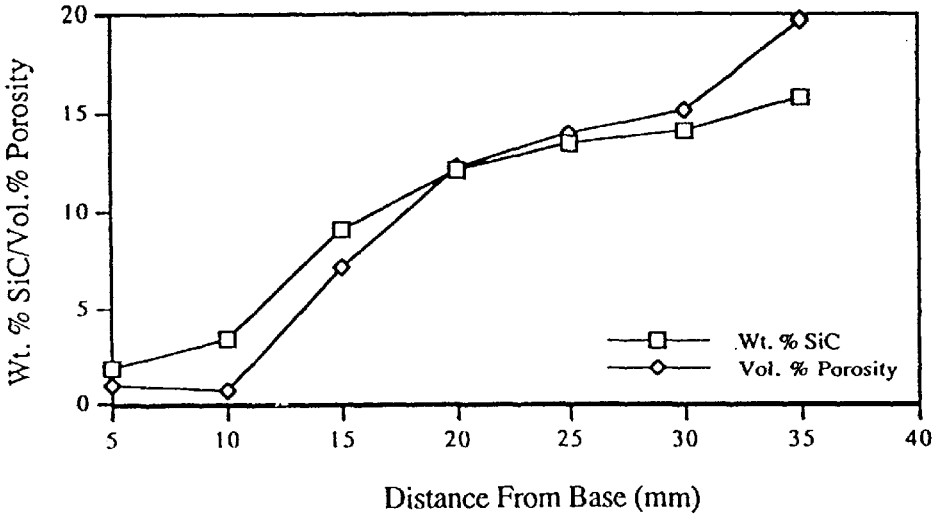
FIG. 3 is a graphical representation of gradient of SiC particulates and volume percent porosity in the case of Al/18SiC functionally gradient material.
Figure 4:
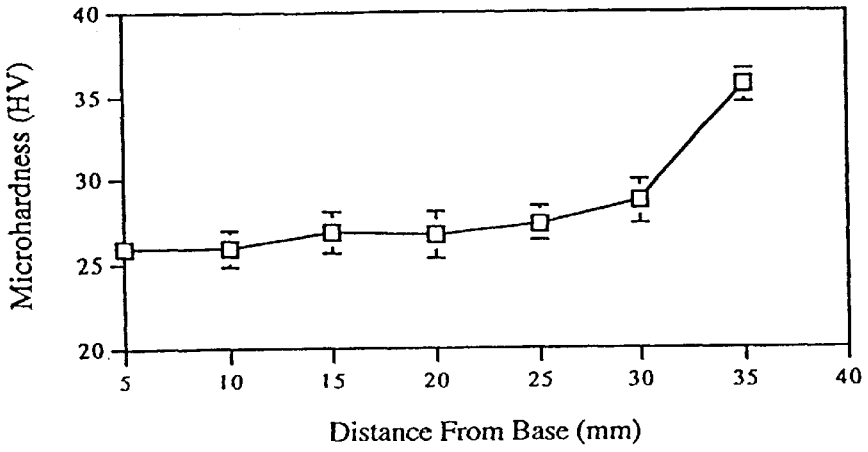
FIG. 4 is a graphical representation of variation in microhardness as a result of presence of gradient of SiC particulates in the case of Al/18SiC functionally gradient material.
Figure 5:
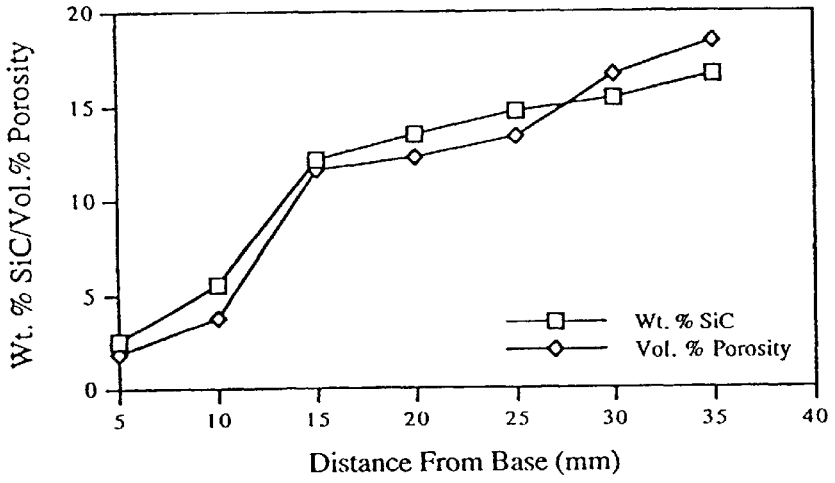
FIG. 5 is a graphical representation of gradient of SiC particulates and volume percent porosity in the case of Al/20SiC functionally gradient material.
Figure 6:
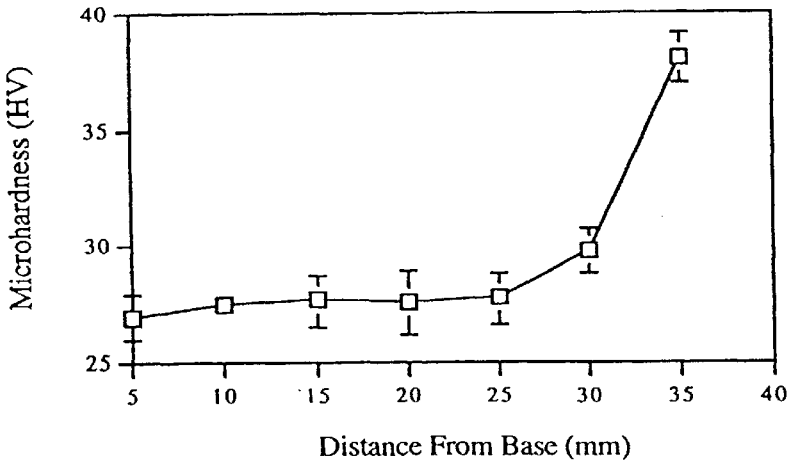
FIG. 6 is a graphical representation of variation in microhardness as a result of presence of gradient of SiC particulates in the case of Al/20SiC functionally gradient material.

FIGS. 1–6 and Table 1 clearly show that the experimental methodology used in the present study is capable of establishing one dimensional gradient of SiC particulates in the aluminum matrix which leads to a progressive increase in the microhardness of the matrix. The results also show that an increase in the starting weight percentage of added SiC particulates also lead to an increase in the gradient of SiC particulates.

Those skilled in the art will appreciate that the invention described herein is susceptible to variations and modifications other than those specifically described. It is to be understood that the invention includes all such variations and modifications which fall within its spirit and scope.

What is claimed is:

1. A process for the manufacture of a metal/ceramic based functionally gradient material comprising the steps of:

(a) melting a metal in a crucible;

(b) adding a solid particulate ceramic material to the molten metal;

(c) vortex mixing to create a vortex in the molten metal and particulate ceramic material to form a gradient slurry;

(d) allowing the slurry to flow from the crucible; and (e) disintegrating the slurry using jets of inert gas such that the disintegrated slurry is deposited on a substrate to form the functionality gradient material.

2. A process according to claim 1, wherein the vortex mixing step (iii) comprises stirring the molten metal and particulate ceramic material at from about 250 to about 310 rpm.

3. A process according to claim 1, wherein in step (iv) the gradient slurry is allowed to flow from a hole located in the base of the crucible.

4. A process according to claim 1, wherein the disintegrated slurry deposited on the substrate in step (v) has a lower concentration of ceramic particles at the base of the deposited slurry relative to the concentration of ceramic particles at the top of the deposited slurry.

5. A process according to claim 1, wherein the substrate is a metallic substrate.

6. A process according to claim 1, wherein the metal of the functionally gradient material is selected from aluminium, titanium, magnesium and copper, and alloys thereof.

7. A process according to claim 1, wherein the ceramic material is selected from silicon carbide, graphite and alumina particles.

8. A process according to claim 7, wherein the particles have a size range of from 3 $\mu$m–100 $\mu$m.

9. A process according to claim 1, wherein in step (v) the jets of inert gas are aligned at about 90° to the axis of the slurry flowing from the crucible.

10. A process according to claim 1, wherein the inert gas is selected from argon and nitrogen.

11. A process according to claim 1, wherein during steps (ii) and (iii) the molten metal is held at a temperature sufficient to wet the ceramic particles.

12. A functionally gradient material manufactured by the process according to claim 1.

13. A process as recited in claim 1, wherein said steps of adding and vortex mixing occur simultaneously.

* * * * *